US010532532B2

(12) United States Patent
Danielsson

(10) Patent No.: US 10,532,532 B2
(45) Date of Patent: Jan. 14, 2020

(54) COMPACT SHREDDER AND COMPACTOR

(71) Applicant: DANIELSSON INNOVATION AB, Smedjebacken (SE)

(72) Inventor: Tomas Danielsson, Smedjebacken (SE)

(73) Assignee: Danielsson Innovation AB, Smedjebacken (SE)

( * ) Notice: Subject to any disclaimer, the term of this patent is extended or adjusted under 35 U.S.C. 154(b) by 1091 days.

(21) Appl. No.: 14/441,080

(22) PCT Filed: Nov. 6, 2013

(86) PCT No.: PCT/SE2013/051303
§ 371 (c)(1),
(2) Date: May 6, 2015

(87) PCT Pub. No.: WO2014/074060
PCT Pub. Date: May 15, 2014

(65) Prior Publication Data

US 2015/0290895 A1 Oct. 15, 2015

(30) Foreign Application Priority Data

Nov. 6, 2012 (SE) ..... 1251260

(51) Int. Cl.
*B02C 19/22* (2006.01)
*B02C 23/02* (2006.01)
*B30B 9/32* (2006.01)

(52) U.S. Cl.
CPC ..... *B30B 9/326* (2013.01); *B02C 19/22* (2013.01); *B02C 23/02* (2013.01); *B30B 9/327* (2013.01)

(58) Field of Classification Search
CPC ..... B02C 19/22; B30B 9/326; B30B 9/327
USPC ..... 241/260.1, 186.5, 82.1, 101.2
See application file for complete search history.

(56) References Cited

U.S. PATENT DOCUMENTS 2,322,058 A * 6/1943 Powers ..... E03C 1/2665 241/260
3,384,138 A * 5/1968 Johnson ..... A01F 11/06 241/101.01
3,907,215 A * 9/1975 Mantelet ..... A47J 42/24 241/88.4

(Continued)

FOREIGN PATENT DOCUMENTS

DE 2702653 A1 7/1978
EP 0395454 10/1990

(Continued)

OTHER PUBLICATIONS

International Search Report for International Application No. PCT/SE2013/051303 dated Feb. 18, 2014 (3 pages).

(Continued)

*Primary Examiner* — Shelly M Self
*Assistant Examiner* — Smith Oberto Bapthelus
(74) *Attorney, Agent, or Firm* — Merchant & Gould P.C.

(57) ABSTRACT

A shredder includes a feed screw that pushes the items to be shredded and compacted towards an opening in the shredder via a restrictor that includes a pipe portion leading to the opening in the shredder, the shredder includes a drive motor driving a miller screw which shreds the items to be shredded into acquired size against a cutter plate fastened to a cutter housing to form shredded items, and forces the shredded items into a press chamber.

3 Claims, 4 Drawing Sheets

(56) References Cited

Figure 1:
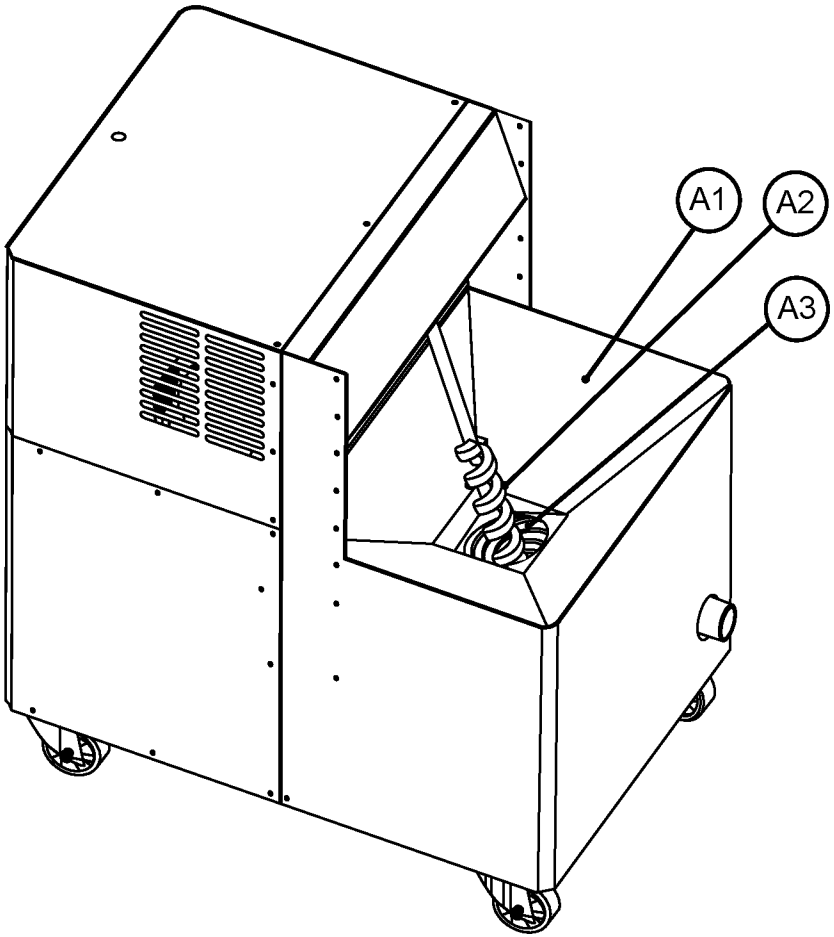

U.S. PATENT DOCUMENTS 4,056,379 A * 11/1977 Kelly ..... C03B 23/031 65/106
4,157,025 A * 6/1979 Vydrin ..... B21J 7/18 72/189
4,416,543 A * 11/1983 Brinkmann ..... B01F 7/14 366/288
4,712,641 A * 12/1987 Chelminski ..... G01V 1/047 181/113
4,944,333 A * 7/1990 Gold ..... B09B 3/0058 141/329
RE33,799 E * 1/1992 Gold ..... B09B 3/0058 141/231
5,186,219 A * 2/1993 Gold ..... B09B 3/0058 141/329
6,572,037 B1 * 6/2003 Bendzick ..... B02C 18/142 241/166
6,588,690 B1 * 7/2003 Koenig ..... A61L 11/00 241/260.1
2009/0072058 A1 * 3/2009 Salgado ..... A22C 17/0026 241/82.5
2010/0330217 A1 12/2010 Kim et al.
2011/0214577 A1 * 9/2011 Kim ..... A47J 43/00 99/537
2015/0290895 A1 * 10/2015 Daniellson ..... B02C 19/22 100/97

FOREIGN PATENT DOCUMENTS

JP H08-300191 A 11/1996
JP H09142667 6/1997
JP H10-528 A 1/1998
JP 2002-283175 A 10/2002
KR 20100007089 1/2010

OTHER PUBLICATIONS

Extended European Search Report issued in European Application No. 13852866.6, dated Jun. 14, 2016.

* cited by examiner

COMPACT SHREDDER AND COMPACTOR

This application is a National Stage Application of PCT/SE2013/051303, filed 6 Nov. 2013, which claims benefit of Serial No. 1251260-4, filed 6 Nov. 2012 in Sweden and which applications are incorporated herein by reference. To the extent appropriate, a claim of priority is made to each of the above disclosed applications.

FIELD OF THE INVENTION

A compact machine shreds and compresses waste metal chips. It can process long or short chips and also reject solid slugs. It is made for receiving chips directly from CNC turning, milling or other manufacturing machine via chip conveyor. The main component, shredder and press can also be built into the CNC manufacturing machine. This provides possibilities to significantly reduce footprint of CNC machine.

PRIOR ART

In the field of taking care of chips from metal cutting operations, it is a well known problem that a single device cannot process both long chips, short chips and solid material into briquettes. There are assemblies capable of this, but until now, such machinery has been assemblies of a shredder, a cutter, or shredder, and a compacting part. If a solid piece of material ends up in the shredder, it is not unusual that the shredder breaks. Moreover, providing three different components in the same machine has proven to be costly.

Current chip compactors are only designed to handle short chips and cannot handle solid slugs. To make these systems handle long chips one must by third party shredder and in some way build it into the compactor. This is not attractive for buyer as it adds up to an expensive and complicated system that might not work efficient in the end. Problems to reject solid slugs also remain to be solved. A customer normally wants to buy a complete system without customization with third party products. A system that can handle long chips and reject solid slugs are today treated as custom build projects for larger companies. These systems are expensive and massive in footprint.

It is the object of the present invention to provide a shredder and compactor enabling shredding and compacting of both long and short chips, while being able to reject solid slugs.

SUMMARY OF THE INVENTION

The above and other problems are solved by a shredder comprising a feed screw that pushes the items to be shredded and compacted towards an opening in a shredder via a restrictor comprising a pipe like portion leading to the opening in the shredder housing, the shredder comprising a drive motor driving a miller screw which shreds items to be shredded into acquired size against a cutter plate fastened to the cutter housing and forces the shredded items into a press chamber.

In order to provide cutting of long chips and transport of short or cut chips, chips may received in the shredder radially, the shredder redirecting them axially and precompressing chips in a press chamber.

In order to improve the volume capacity and prevent cut chips from co-rotating with a miller screw housed in the cutter housing, the cutter housing may have internal spiral grooves, thus providing improved volume capacity and capability to efficiently preload press chamber.

In order for enabling rejection of noncuttable slugs, the cutter housing may be rotated and reject solid slugs.

For facilitating cleaning, e.g. when changing alloy to be machined, a chip box comprising the restrictor can be flipped up for easy cleaning access when changing alloys to be pressed.

DESCRIPTION OF EMBODIMENTS

Figure 2:
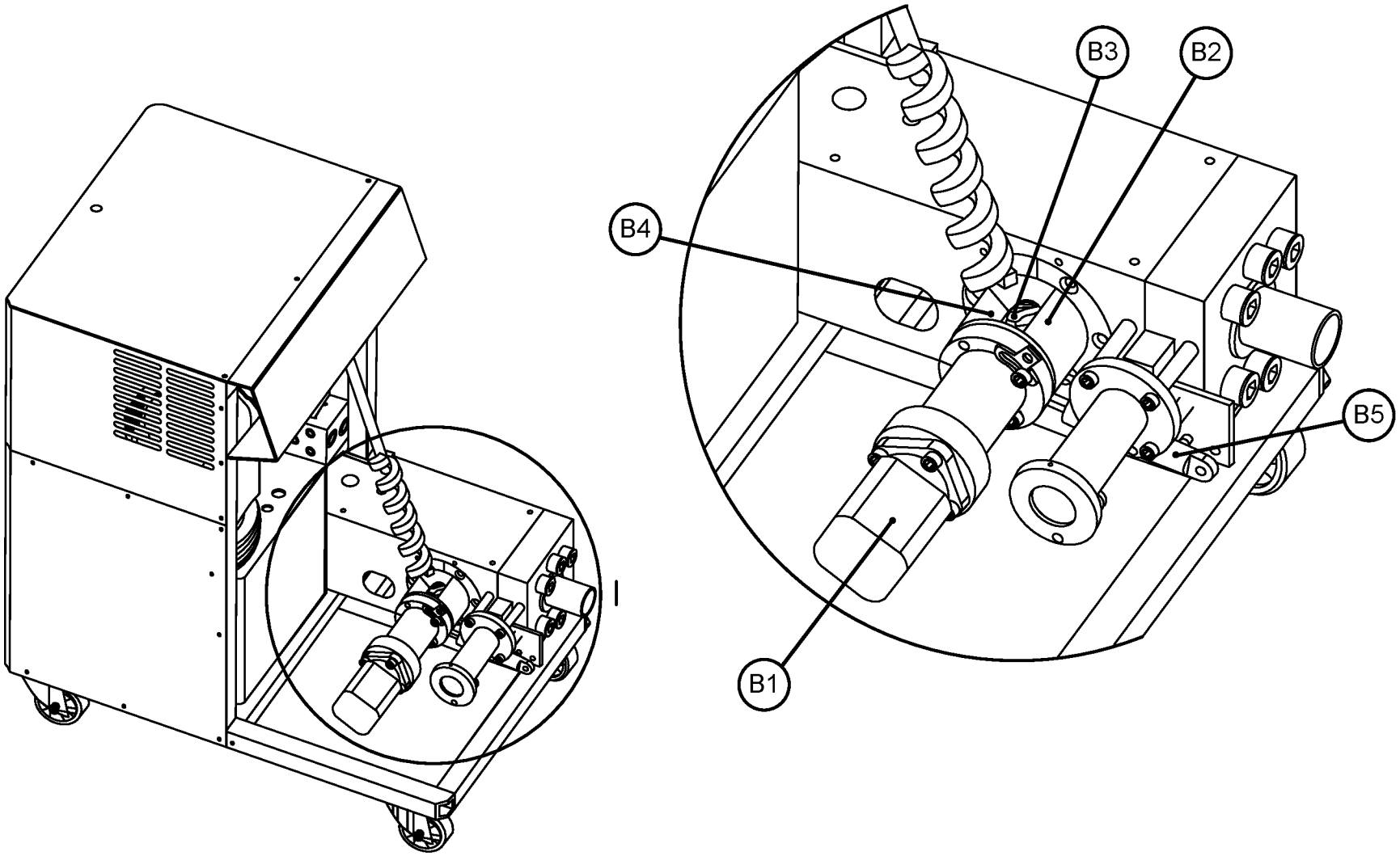
Figure 3:
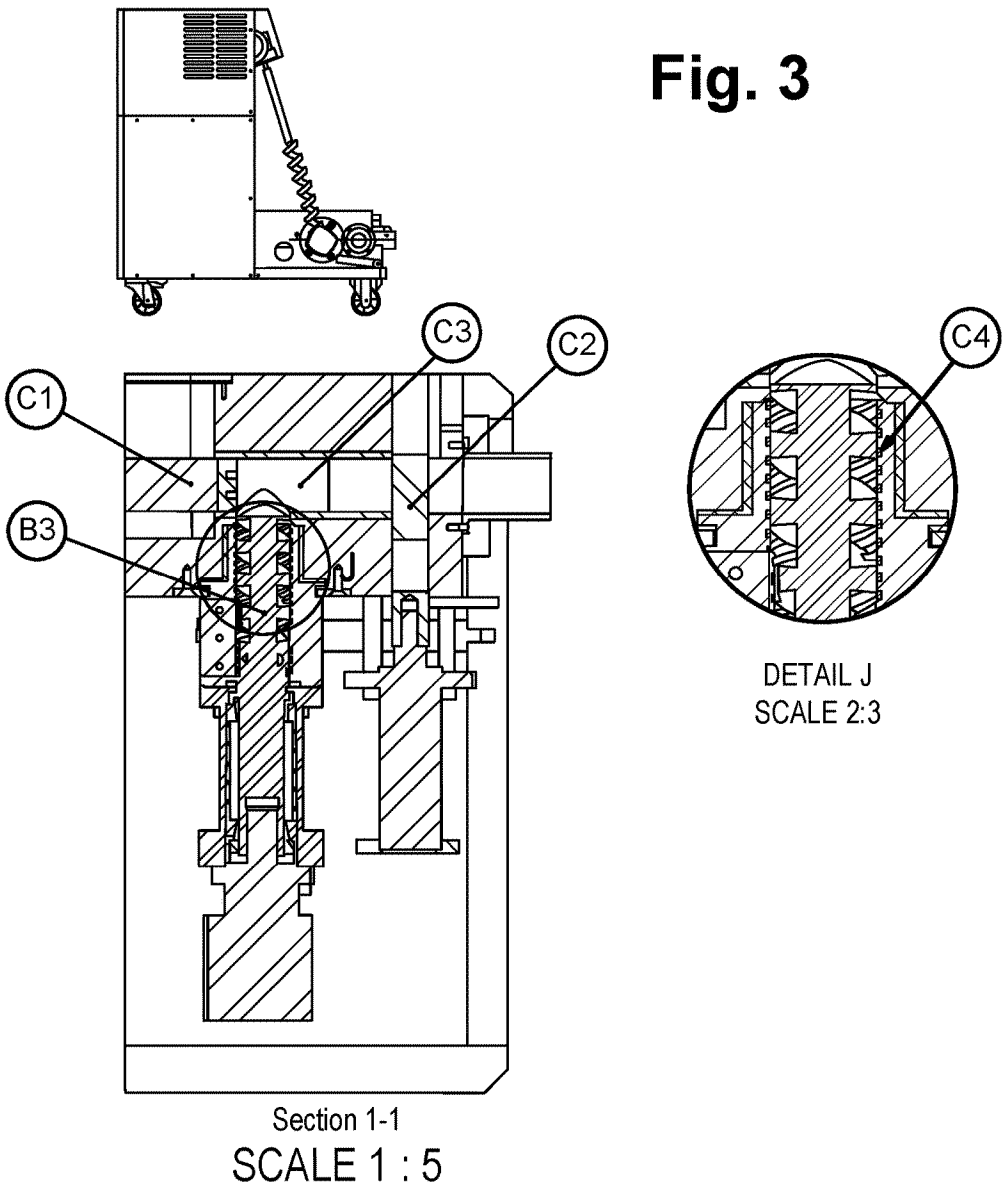
Figure 4:
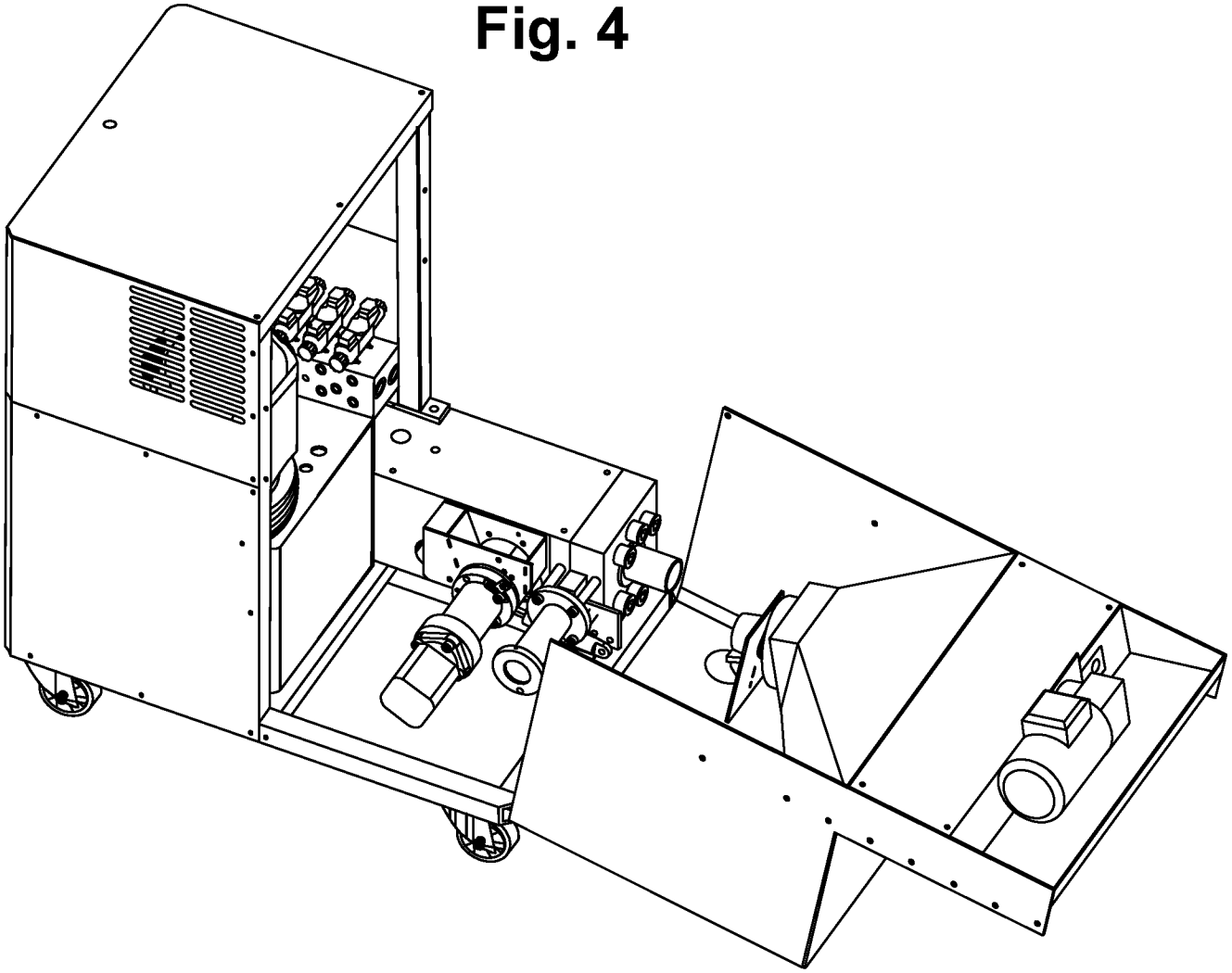

With reference to FIG. 1, a compact shredder and compactor according to the present invention is shown, Metal chips to be compacted into briquettes are dumped in a chip box (A1) by e.g. a CNC machine conveyor or manually by person (not shown). A feed screw (A2) pushes the chips towards an opening in a cutter (see FIG. 2) via a restrictor (A3) comprising a pipe like portion leading to the opening in the cutter. With reference to FIGS. 2-4, the cutter comprises a drive motor (B1) placed on one end of the cutter housing (B2) having internal spiral grooves (C4) and driving a miller screw (B3), i.e. a screw providing both a cutting action and a transporting action for items having been cut, which shreds, or cuts, long chips into acquired size against a cutter plate (B4) fastened to the cutter housing. Chips in the desired size are then forced in the axial direction of the miller screw into a press chamber (C3). Once a desired amount of chips are gathered in the press chamber, the chips are compacted by a piston having a shape corresponding to the press chamber and being powered by e.g. a hydraulic piston (C1) arranged in one end of the press chamber. After the compression, a gate (C2) at an opposite end of the press chamber opens and compacted slugs are pushed out by the piston maneuvered by the hydraulic press piston (C1).

If any solid slug would block the miller screw (B3), a tilt cylinder (B5) will rotate the cutter housing (B2), such that the solid slug will not be engaged by the miller screw and the cutter plate and hence be rejectable, e.g. by the force of gravity once the cutter housing has rotated such that the opening points downwards. After the solid slug has been rejected, the cutter housing will be rotated back to its original position and the process can continue.

One way of determining that a non-shreddable item has been stuck in the miller screw/shredder housing is to monitor the torque applied by the drive motor. This monitoring of the torque could be achieved e.g. by monitoring the drive current to the drive motor. If the applied torque exceeds a certain threshold value, the above sequence for rejecting a stuck item may be implemented.

It is advantageous to be able to tilt, or rotate, the cutter housing if an item has stuck and blocks the miller screw; it is of course possible to reverse the direction of the miller screw in order to release the too large item having been stuck, but if the housing is not rotated, the restrictor (A3) comprising a pipe like portion leading to the opening in the cutter will stop the stuck item from being removed from its blocking position. Moreover, if the housing is rotated such that the opening faces downwards, gravity will help removing the stuck item.

Preferably, the feed screw is shut off prior to the shredder housing being rotated in case of a stuck item requiring removal.

In another embodiment of the invention, there is no tilt cylinder provided for rotating the cutter housing; instead, the rotation of the cutter housing is achieved by providing the housing on bearings allowing for rotation and a locking system enabling the cutter housing to be locked in desired positions. If an object has stuck, the locking system may release the cutter housing, Thereafter, the miller screw is rotated in the cutting direction, bringing the cutter housing with it. Once the cutter housing has reached the desired position, the cutter housing is locked and the miller screw is rotated in the opposite direction, i.e. the direction releasing the stuck item, such that the stuck item may be rejected.

The system disclosed above and in the drawings can handle long or short chips and reject solid slugs that cannot be shredded and are too large for being transported into the press chamber. It is designed from beginning to do this with few parts in a compact package. This covers all possible working conditions and provides one stop shopping at attractive price. The compactness and price gives possibilities for small workshops to own a recycling system. This will give them much more money back per kilo of waste material. Cutting fluids will be fed back to manufacturing machine; this will provide a significant improvement on environmental issues. The fact that chips are compacted directly at the CNC machine will guarantee that no chips are wasted into nature; this is the biggest environmental profit. Every lost kilo of material must in the end be compensated by mining more from the earth. It's much more energy efficient to recycle material. Current system does not provide possibilities for the great mass of workshops to recycle their material in an efficient and economical way.

The invention claimed is:

1. A shredder comprising a feed screw that pushes items to be shredded and compacted towards an opening in the shredder via a restrictor comprising a pipe portion leading to the opening in the shredder, the shredder comprising a drive motor driving a miller screw within a cutter housing, wherein the miller screw shreds the items to be shredded into acquired size against a cutter plate within the cutter housing to form shredded items, and forces the shredded items into a press chamber, wherein the cutter housing is constructed to be rotated to reject solid slugs, and further comprising a tilt cylinder constructed to rotate the cutter housing about the miller screw.

2. The shredder according to claim 1, wherein the items to be shredded and compacted comprise chips, and the chips are received in the shredder radially and the shredded items are redirected axially and compressed in the press chamber.

3. The shredder according to claim 1, wherein a chip box comprising the restrictor is constructed to be flipped up for easy cleaning access when changing alloys to be pressed.

* * * * *